US010953439B2

(12) United States Patent
Abdul-Ali

(10) Patent No.: US 10,953,439 B2
(45) Date of Patent: Mar. 23, 2021

(54) PORTABLE OVERNIGHT DEGREASING SYSTEM AND METHOD OF USE

(71) Applicant: Gregory Abdul-Ali, Marietta, GA (US)

(72) Inventor: Gregory Abdul-Ali, Marietta, GA (US)

( * ) Notice: Subject to any disclaimer, the term of this patent is extended or adjusted under 35 U.S.C. 154(b) by 213 days.

(21) Appl. No.: 15/852,545

(22) Filed: Mar. 14, 2018

(65) Prior Publication Data

US 2019/0283088 A1 Sep. 19, 2019

Related U.S. Application Data

(63) Continuation-in-part of application No. 14/158,838, filed on Jan. 19, 2014, now abandoned.

(51) Int. Cl.

*B08B 3/04* (2006.01)
*B08B 3/00* (2006.01)
*B08B 3/10* (2006.01)

(52) U.S. Cl.

CPC ..... *B08B 3/044* (2013.01); *B08B 3/006* (2013.01); *B08B 3/10* (2013.01); *B08B 2203/007* (2013.01)

(58) Field of Classification Search

CPC ..... B08B 3/006; B08B 3/08
See application file for complete search history.

(56) References Cited

U.S. PATENT DOCUMENTS 4,317,720 A * 3/1982 Hawk ..... A47L 15/14 210/114
4,462,415 A * 7/1984 Otzen ..... B08B 3/006 134/111
5,827,374 A * 10/1998 Mansur ..... B08B 3/006 134/12
6,202,657 B1 * 3/2001 Cardemon ..... B08B 3/006 134/135
6,609,258 B1 * 8/2003 Clements ..... B08B 3/006 206/576
2008/0210276 A1 * 9/2008 Porter ..... B08B 3/006 134/198
2010/0078904 A1 * 4/2010 Collins ..... B08B 3/006 280/47.11
2012/0024328 A1 * 2/2012 Maanum ..... B08B 3/006 134/56 R
2018/0304313 A1 * 10/2018 Tabrizi ..... B08B 3/006

* cited by examiner

*Primary Examiner* — Spencer E Bell

(57) ABSTRACT

The invention relates to a portable overnight degreasing system, a work station and a method of use. The invention includes a portable soak tank with a disposable liner bag liner removably placed within the interior of the soak tank. The liner bag is then filled with a cleaning solution and soiled items are lowered into the bag liner upon removable grates. An agitator pump is positioned within the portable soak tank to agitate the cleaning solution. The soiled items remain within the locked soak tank overnight or until grease and carbon falls off of the soiled items. An optional heater may be used within the soak tank to increase the speed of degreasing. The soak tank also includes a slanted floor that funnels fluid from the interior of the soak tank into a pipe that connects to a valve on the front wall of the soak tank. Fluid is removed from the system through the valve and then the empty liner bag is disposed. When used as a workstation, a protective cover is placed over the lid and upper portion of the soak tank and a cutting board is placed over the protective cover in a recessed pocket for use by kitchen staff.

19 Claims, 10 Drawing Sheets

Soak Tank Closed

PORTABLE OVERNIGHT DEGREASING SYSTEM AND METHOD OF USE

CROSS-REFERENCE TO RELATED APPLICATIONS

This instant application is a continuation-in-part of U.S. patent application Ser. No. 14/158,838 filed Jan. 19, 2014.

TECHNICAL FIELD

The disclosure relates generally to a portable overnight degreasing system and its method of use, wherein the system is easily maneuverable through commercial kitchens, the system is easily drained completely and the system provides a work station when not being used to degrease an object.

BACKGROUND

Kitchen appliances, such as hood filters, pots, pans, and the like accumulate large deposits of carbon and grease during normal daily usage. Many layers are baked on throughout the day without being cleaned. These deposits are removed regularly in order to maintain a sanitary cooking environment. Failure to remove these deposits can result in an unsanitary cooking environment that may not be compliant with local health codes and also may foster conditions that may constitute a fire hazard.

Removing the deposits from the kitchen appliances can be a very time consuming process, especially in commercial kitchens, which can be operational up to 24 hours a day. Commercial kitchens would benefit from a system for cleaning the appliances without occupying a large portion of the kitchen, a large amount of the kitchen staff and/or a large amount of the kitchen staff's time.

Presently, commercial kitchens utilize conventional methods of dishwashing for smaller cooking utensils and hire outside companies to clean the larger items like hood filters. Examples of conventional methods include: manually scrubbing, acid baths, caustic chemical soaking and boiling. Conventional cleaning methods reduce the efficiency of the kitchen because the kitchen staff must allocate a substantial portion of the day to cleaning the utensils rather than other kitchen tasks. In addition, the cleaning materials used in conventional methods often damage the utensils and are often relatively ineffective. Hiring an outside cleaning service adds a regular expense to the cost of running commercial kitchens, which often run on very tight budgets. A cleaning system for the smaller and larger cooking apparatuses would increase kitchen efficiency and reduce cost.

Cleaning systems, such as automatic dishwashers, are currently utilized in many commercial kitchens. These dishwashers can be very large and cumbersome, thereby occupying large swaths of kitchens for only one use, dishwashing.

Existing prior art has attempted to solve these kitchen problems through the use of soak tanks. The prior art OZ Tank© includes a double skinned soak tank that electrically heats a solution to remove grease from kitchen utensils soaked within the tank. The OZ Tank© has several disadvantages. The OZ Tank© utilizes a heater that requires a constant flow of electricity, the lining of the tank is stainless steel and must be cleaned after the removal of the cleaning solution, and the tank drain is positioned near floor level, which makes it difficult to drain the cleaning solution into a slop sink or commode.

The prior art Fog Tank includes a soak tank that heats a carbon removing powder and water to 185 degrees Fahrenheit. Kitchen equipment is placed in the tank and soaked to remove carbon and grease. However, the Fog Tank requires constant electricity to maintain the fluid at 185F, the interior of the tanks needs to be cleaned regularly, and the drain is near floor level making it difficult to drain the fluid from the tank into a slop sink or commode.

The prior art Clean X-Press includes a metal tank filled with a cleaning solution. Kitchen appliances are placed within the metal tank and heated using an electronic heater. The appliances remain in the solution for an extended period of time until the carbon and grease is loosened to a point that it may be scrubbed off in a kitchen sink. The disadvantages of the Clean X-Press are that it needs a constant flow of electricity to function, the tank is lined with metal that must be cleaned after uses, and the drain is positioned near floor level, which makes it difficult to drain the cleaning solution into a slop sink or commode.

SUMMARY OF INVENTION

The present invention involves a system and method of removing grease and carbon from kitchen appliances overnight. The present invention overcomes many of the disadvantages of prior soak tanks by providing a disposable liner bag to minimize cleaning time, a degreasing solution that removes grease and carbon without heat, a drain positioned 16 inches or more above the floor to allow easy drainage into a slop sink or grease trap, a donut plug that seals an interface between the disposable liner bag and an opening in the front wall of the tank, an impermeable protective cover to create a preparation station atop the soak tank, and 10 inch diameter caster wheels along the bottom of the tank to allow the system to be easily moved about or out of the kitchen when necessary to maximize kitchen space.

In commercial kitchens, carbon and grease build up on kitchen appliances during regular usage. Specifically, the grease accumulates on appliances, such as pots, pans, sheet pans, fry baskets, sauté pans, stove parts, and the like. Carbon deposits accumulate on the oven racks, hood filters, grills, and the like. These appliances must be cleaned to maintain a sanitary kitchen, as well as, conform to health regulations. Presently, kitchen staffs use conventional methods including: manually scrubbing, acid baths, caustic chemical soaking and boiling to remove carbon and grease. Kitchens also employ outside cleaning companies or use soak tanks that include electric heaters to heat the cleaning fluid to near boiling temperatures. These methods are time consuming and costly to the average commercial kitchen.

In one embodiment the portable overnight degreasing system comprises a portable soak tank. The soak tank is preferably made of polypropylene, but may be constructed of any suitable material that will maintain integrity during constant contact with cleaning solutions disposed within. Stainless steel is another example of a material for constructing the soak tank. The soak tank is preferably 52 inches long, 33.5 inches wide and 24 inches deep. The dimensions may vary in size to accommodate smaller or larger kitchens; however, the dimensions will be proportional to the aforementioned dimensions and be able to accommodate kitchen equipment, such as hood filters, drip pans, oven racks and the like.

The interior of the soak tank is lined with a disposable liner bag. The disposable liner bag is flexible in order to conform to the contour of the interior of the soak tank. The removable bag is reusable and disposable, in order to eliminate the need to clean the interior of the soak tank after use, although a simple hot water rinse is recommended. The disposable liner bag is about 50 gallons in volume or proportionally different in size corresponding to the dimensions of the soak tank. The disposable liner bag also has a thickness of about 0.003 inches (3 mils). The open end of the disposable liner bag folds over the top of the tank to prevent contact between the cleaning solution and the interior surface of the soak tank. A hinged, locking lid clamps down upon the folded open end of the liner bag to hold it against the upper rim of the soak tank, thereby preventing the liner bag from falling into the soak tank during use and exposing the interior surface of the soak tank to the cleaning solution. The disposable liner bag may optionally comprise a plastic fitting at the bottom of the bag with a passageway there through. The plastic fitting fits into a corresponding female passageway in the interior surface of the soak tank. The plastic fitting and the female passageway have complementary slots that allow the fitting to be twisted within the female passageway into a locked position. The disposable liner bag may also optionally comprise a deformable plate at the bottom of the disposable bag liner, wherein the deformable plate includes an aperture there through. The aperture is circular and has a diameter slightly smaller than a circular opening in the floor of the interior of the soak tank. The disposable liner bag is connected to the circular opening by positioning a donut plug through the aperture in the disposable liner bag and the circular opening in the floor. When the donut plug is pushed through the deformable plate into the circular opening and small portion of the deformable plate is pushed into the circular opening and held in place by the perimeter of donut plug pressing it against the interior of the circular opening to form a liquid impermeable seal between the outer perimeter of the aperture and the inner perimeter of the circular opening.

The donut plug is circular and of complimentary diameter to the circular opening of the soak tank near the front wall. The donut plug comprises a rubber gasket disposed around the outer perimeter of the plug. The rubber gasket is resiliently deformable to provide a snug fit within the deformable plate aperture and the circular opening; thereby providing a liquid impermeable seal between the three. The seal prevents the passage of fluid from the disposable liner bag to the surface of the interior of soak tank. This is important to allow the disposable liner bag to be removed after use, while leaving the surface of the interior of the soak tank minimally unstained/untouched by cleaning fluid from the interior of the disposable liner bag. The donut plug also includes a rod that extends diametrically from one portion of the perimeter to another portion of the perimeter of the donut plug. The rod functions as a handle for the user to grasp and maneuver the donut plug. The rod also defines two semi-circle passages through the donut plug, thereby allowing the drainage of the fluid from the interior of the disposable liner bag through the donut plug, but not between the rubber gasket, the deformable plate and the circular opening, during use.

The female passageway or circular opening through the soak tank is in fluid communication with a drain disposed on the exterior of the soak tank. The drain is positioned about 16 inches above the floor on an exterior wall of the soak tank. The 16-inch height of the drain allows for a more convenient flow of fluid out of the tank into a slop tank or grease trap, while still utilizing gravity to maintain fluid flow from the soak tank. The drain has a 2-3 inch diameter, which differs from prior art that uses 1-inch drains, thereby improving upon the slower drainage in the prior art, and the possibility of clogging. The drain is constructed of PVC or any suitable material for use. The drain further comprises a threaded male projection that may be fluidly connected to a hose for directing the fluid from the soak tank to a distant receptacle. The drain incorporates a shut off valve mechanism to control the rate of flow from the drain. The valve mechanism may include one of a knife gate, ball valve, butterfly valve, disk valve, or any suitable valves know in the art. The exterior wall of the soak tank where the drain is disposed is slanted at 30-60 degrees relative to the horizontal outer, bottom floor of the soak tank. This slant also tilts the drain to prevent pooling of fluid within the drain during draining.

The portion of the front wall where the drain is positioned is a concave surface. This concave surface prevents the drain from projecting beyond the front surface of the exterior front wall. This protects the drain from being damaged by bumping the drain into remote objects while maneuvering the system about.

The interior floor surface of the soak tank is angled at up to 45 degrees from front to back with respect to the floor of the room. The interior floor surface of the soak tank is also angled at up to 33 degrees from the lateral sides to the longitudinal center of the bottom surface, thereby creating a V-shaped cross-section through the bottom surface, when viewed from front to back. The angled surfaces direct the flow of fluid within the soak tank towards the circular opening in the front wall of the interior of the soak tank. The degree of bilateral slope and the degree of the descending slant can vary per required application.

The interior of the soak tank also includes a grate. The surface area of the grate is sized to be slightly smaller than the cross-sectional area of the interior of the soak tank, in order to allow the grate to be lowered and raised within the soak tank while holding the kitchen appliances. The grate is held in place within the soak tank by sitting upon four catches within the soak tank, wherein each interior wall of the soak tank includes a corresponding catch. The catches also maintain the position of the disposable liner bag. The grate further includes 2 handles disposed on opposite longitudinal ends of the grates. Alternatively, the grate may include 4-8 legs disposed on the bottom surface of the grates. The legs rest upon the interior surface of the disposable liner bag, thereby pressing the liner bag against the interior surface of the soak tank and holding the liner bag in place within the soak tank. The legs each include rubber tips to prevent the legs from piercing or tearing the disposable liner bag, thereby allowing fluid to contact the interior surface of the tank.

When the 50-gallon disposable liner bag is positioned within the soak tank and filled with cleaning solution and kitchen appliances, the whole portable degreasing system can weigh up to about 700 lbs. The weight and size of the system make it difficult to maneuver, especially in the tight spaces of a commercial kitchen. In order to alleviate this problem the portable degreasing system includes four to six 10 to 12 inch diameter caster wheels positioned longitudinally along the bottom surface of the exterior of the soak tank. The tank may include; two 10-inch swivel caster wheels positioned on the front of the bottom surface, two 10-inch swivel caster wheels positioned on the back of the bottom surface, and two 10-inch stationary caster wheels positioned in the center of the bottom surface on lateral sides. The swivel wheels on the front and back allow the system to rotate 360 degrees about an axis of rotation that is drawn vertically through the center of the system, which is advantageous for maneuvering into small spaces because the system does not have to make wide turns. The two stationary wheels help steady the device and prevent incidental lateral movement while moving the system. All the wheels are 10 to 12 inches in size to allow the system to roll over bumps and cracks without becoming stuck due to the wheels being small enough to fit into the cracks or not tall enough to roll over a bump.

The vacant space between the interior floor surface of the soak tank and the bottom surface of the exterior of the soak tank is fitted with storage compartments. The storage compartment includes a lockable, hinged door that covers the four storage compartments. The compartments are sized to accommodate bags, gloves, goggles, aprons, etc.

The upper portion of the soak tank includes a lid hinged to either lateral side of the upper portion of the soak tank. The hinge allows the lid to be opened or closed upon the open end of the soak tank. One or both of the longitudinal ends of the upper portion of the soak tank includes a handle for the user to maneuver the degreasing system. The lid includes a recessed pocket in the upper surface of the lid. The recessed pocket is sized to receive a commercial cutting board used in commercial kitchens. The system includes an impermeable protective cover that may be placed over the lid and at least halfway down the exterior walls of the soak tank. The protective cover includes an elastic band or string tie configuration on the open end to secure the protective cover to the soak tank. When the impermeable protective cove is placed over the lid and upper portion of the soak tank, a clean surface is created upon the top of the protective cover that is placed upon the lid. A cutting board may be positioned upon the protective cover and simultaneously positioned within the recessed pocket on the top surface of the lid. This allows the top of the soak tank to be used as a clean work preparation station in the kitchen when the soak tank is not being used to degrease. Also, it provides an alternative use for the system within the kitchen other than taking up precious kitchen space when not being used to degrease. The protective cover is made of polyethylene, Spectra®, nylon or another suitable material with a porosity that is impermeable to gas, liquid and vapor. In addition, the protective cover is lightweight and includes fibers of high tensile strength to prevent piercing/tearing the protective cover during use and contaminating the clean area. The protective cover has a thickness of 0.003-0.006 inches (3-6 mils) in order to be thick enough to prevent accidental tearing of the protective cover during food preparation upon it.

The preferred cleaning solution is sodium hydroxide. However, any other caustic or non-caustic cleaning solution that will remove the carbon and grease from a kitchen appliance without damage may be used within the portable overnight degreasing system.

In a second embodiment, an optional electric heater is included in the portable overnight degreasing system. The heater is in addition to all the features of the first embodiment. The heater shortens the amount of time needed to remove the carbon and grease from the kitchen appliances, thereby shortening the operational time of the degreasing system. An agitator is used in the system along with all the features of the first embodiment. The agitator causes turbulence in the liquid, thereby assisting the cleaning solution in removing grease or carbon from the objects within the soak tank. The agitation of the cleaning solution shortens the necessary time for removing grease or carbon from an object in the soak tank.

The third embodiment includes rear supports positioned on the exterior rear wall of the tank. These supports allow the tank to be rested upon the supports and off the wheels when the tank is being positioned to minimize the floor space it occupies for storage or transportation.

The embodiments of the degreasing system are preferably sold in a kit. The kit comprises all the elements of the first or second embodiment and instructions for use. The instructions include the following steps:

1. Remove the grate from the interior of the soak tank;
2. Install the disposable bag liner within the interior of the soak tank, securing it along the open end of the tank and along the catches inside;
3. Replace the grate within the disposable bag liner and the soak tank;
4. Secure the grate along the catches or utilize grates with 4-8 rubber tipped legs;
5. Place soiled items upon the grate;
6. Fill the soak tank with warm water until all soiled items are submerged, but do not fill beyond the "fill line" marked within the soak tank;
7. Wear protective gear (i.e. gloves, goggles, apron, and respirator)
8. Add recommended amount of soak tank degreaser powder/liquid or other degreaser product;
9. Close lid and secure with lock;
10. Allow degreasing action with the agitator overnight or for up to 8 hours; or plug in an optional heater, if available, and allow for up to 6-8 hours of degreasing action;
11. Open lid and remove items from grate;
12. Rinse items with hot water;
13. Re-install or store cleaned items;
14. If solution is spent (i.e. dark colored), open drain valve or attach hose to drain and open valve mechanism to drain solution into a drain, then replace used disposable bag liner with a new disposable bag liner.
15. If solution is not spent (i.e. not opaque) save and reuse from Step 5.

BRIEF DESCRIPTION OF THE DRAWINGS

The novel features believed to be characteristic of the invention are set forth in the appended claims. The invention itself, as well as, a preferred mode of use, further objectives and advantages thereof, will be best understood by reference to the following detailed description of illustrative embodiments when read in conjunction with the accompanying drawings, wherein:

DETAILED DESCRIPTION OF THE INVENTION

The present invention comprises a portable overnight degreasing system and a method of using the system to remove carbon and grease from kitchen appliances without the need for heat.

Figure 1:
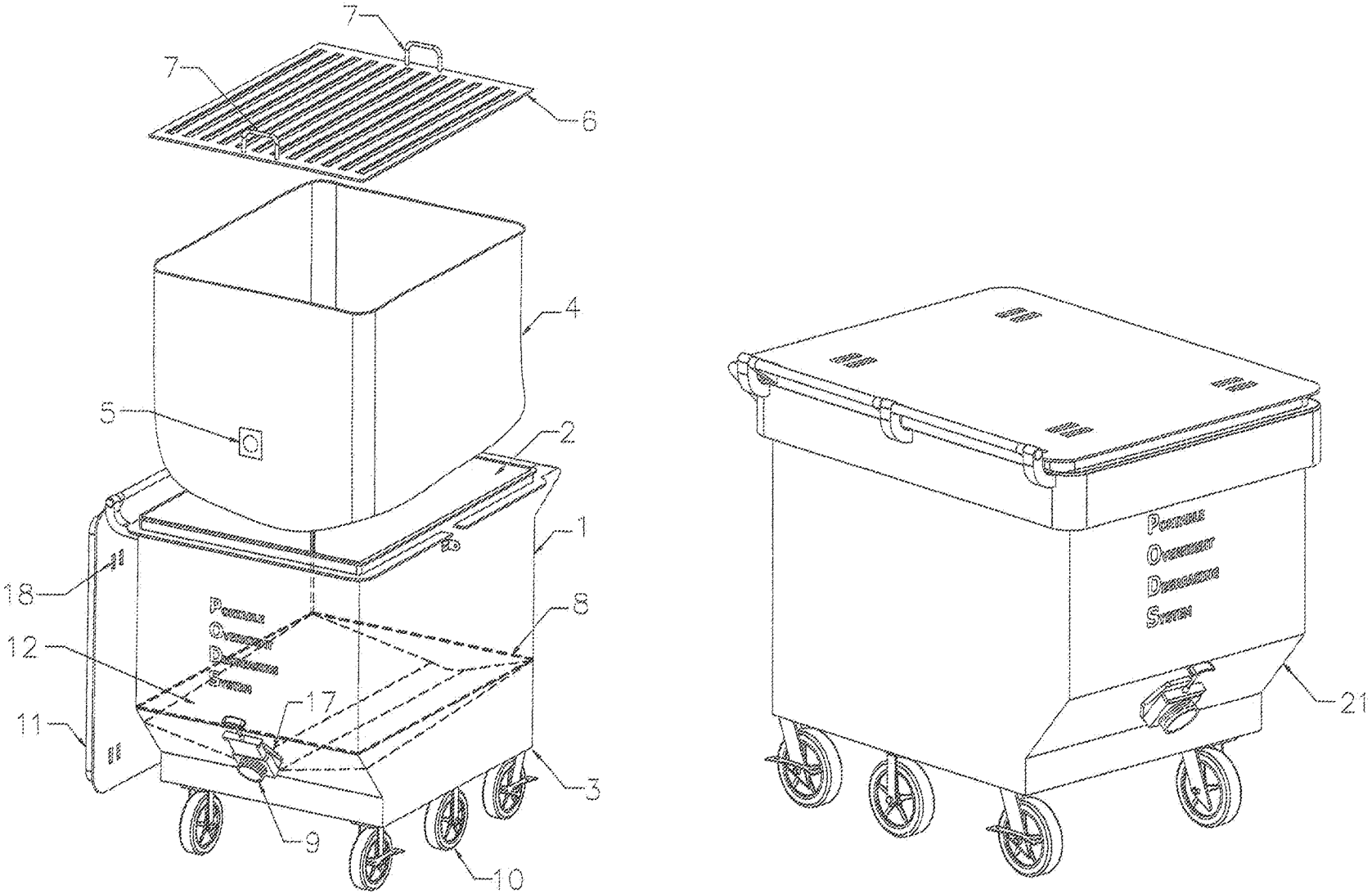
FIG. 1 is a perspective and exploded diagram of the preferred embodiment of the overnight portable degreasing system.

With reference to the drawings and particularly FIG. 1 a portable overnight degreasing system comprises a portable soak tank 1 having an open upper end 2, a closed lower end 3, and four lateral walls, wherein each wall is perpendicular to the adjacent walls. The size and shape of the soak tank 1 can be modified to accommodate a variety of appliances and kitchens. A disposable liner bag 4 is disposed within the interior of the soak tank 1, wherein the liner bag 4 includes a liner bag opening 5 in the lower front portion of the liner bag. The liner bag 4 is flexible and constructed of a durable plastic, rubber, or composite. The liner bag opening 5 is connected to the interior of the front wall 17 of the soak tank 1, wherein the liner bag opening 5 comprises either a male or female connection that is lockably connected to a male or female connection with a lock on the interior of the front wall 17.

Figure 5:
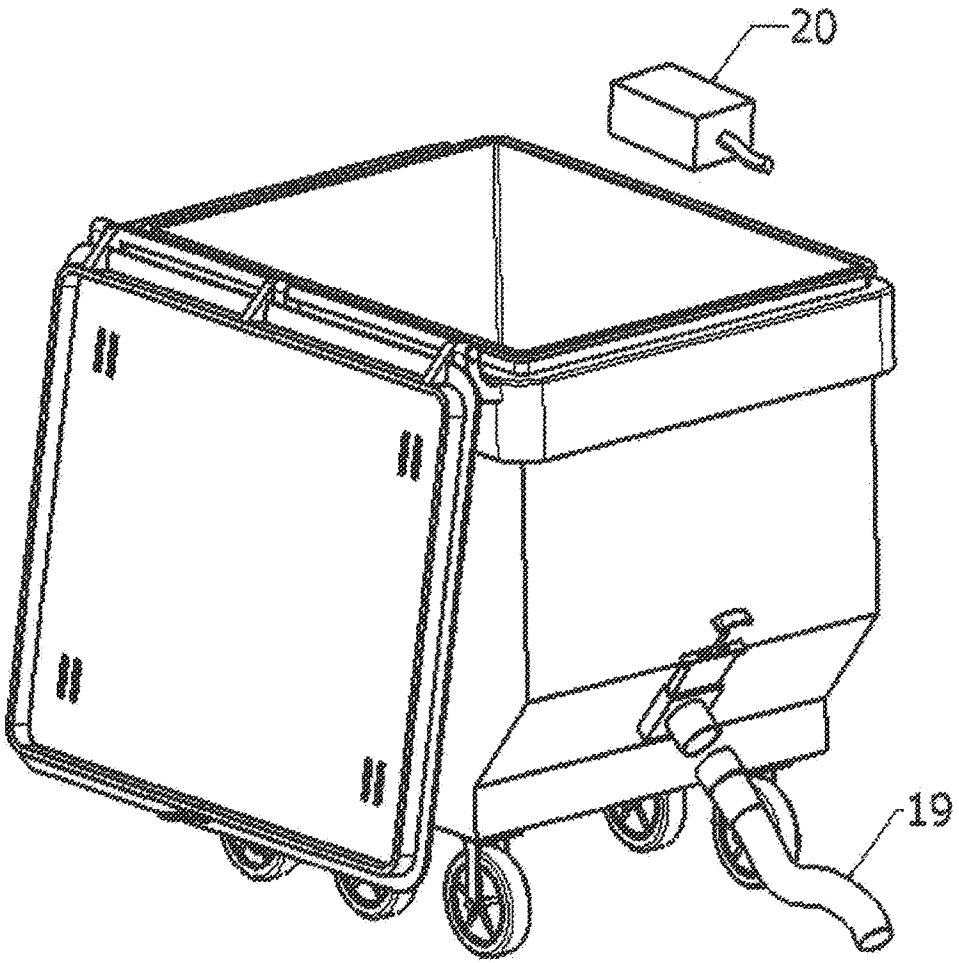
FIG. 5 is a perspective view of the second embodiment.

The front wall 17 includes a drain positioned 16 inches above the floor and on the exterior of the front wall 17. The drain passageway is coextensive with the connection of the interior of the front wall 17 and the liner bag opening 5. The drain comprises a valve mechanism 9, wherein the valve mechanism 9 is preferably a knife gate, but may be ball valve, butterfly valve, disk valve, or any other valve suitable for controlling flow through a drain. A hose 19 may be connected to the distal end of the drain, as shown in FIG. 5, to direct fluid from the system to a floor drain, slop tank, commode, or the like. The length of the hose 19 may vary to accommodate the distance to the waste receptacle and the diameter of the hose 19 may vary to complement the diameter of the drain.

The disposable liner bag 4 holds a grate 6. The grate 6 and liner bag 4 are held in place by catches 8 positioned along the interior walls of the soak tank 1. The catches 8 are a lip that project from the interior of the walls of the soak tank 1 and circumscribes the interior circumference of the soak tank 1. The grates can also include legs which can be positioned on the floor to hold the bag in place. The kitchen appliances being cleaned are lowered into the liner bag 4 via the grate 6 and the grate handles 7. The grate handles 7 can be grasped by the user while lowering or raising the grate 6 into or from the liner bag 4.

The upper end 2 of the soak tank 1 includes a lid 11 that is connected to a lateral side of the soak tank 1 via a hinge. The lid 11 is able to be locked upon the open end 2 of the soak tank 1 when the lid 11 is in the closed configuration, as shown in FIG. 1. The lid 11 also comprises ventilation holes 18 that allow exhaust, if necessary, to escape from the interior of the soak tank 1 during use.

Figure 2:
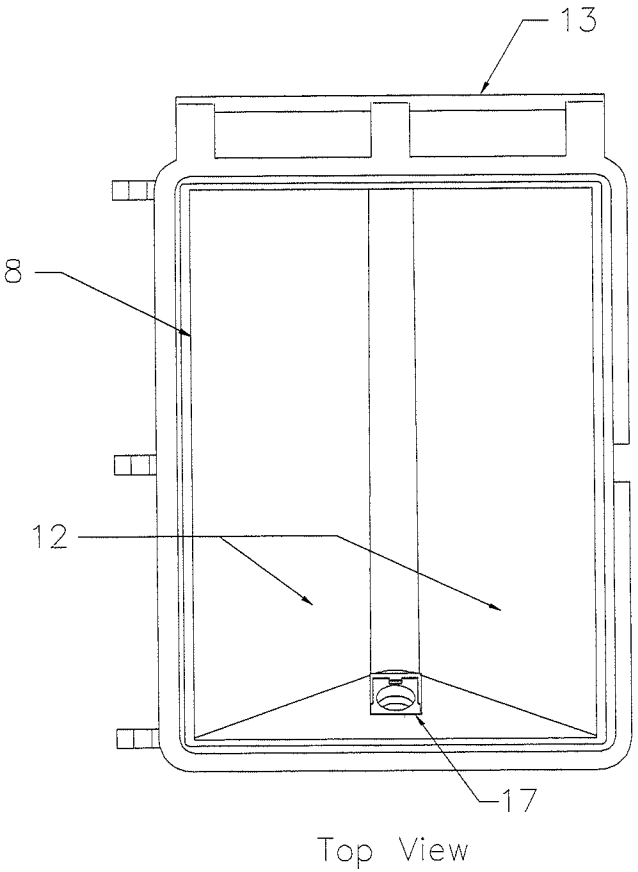
FIG. 2 is a top sectional view of the system in FIG. 1.
Figure 2:
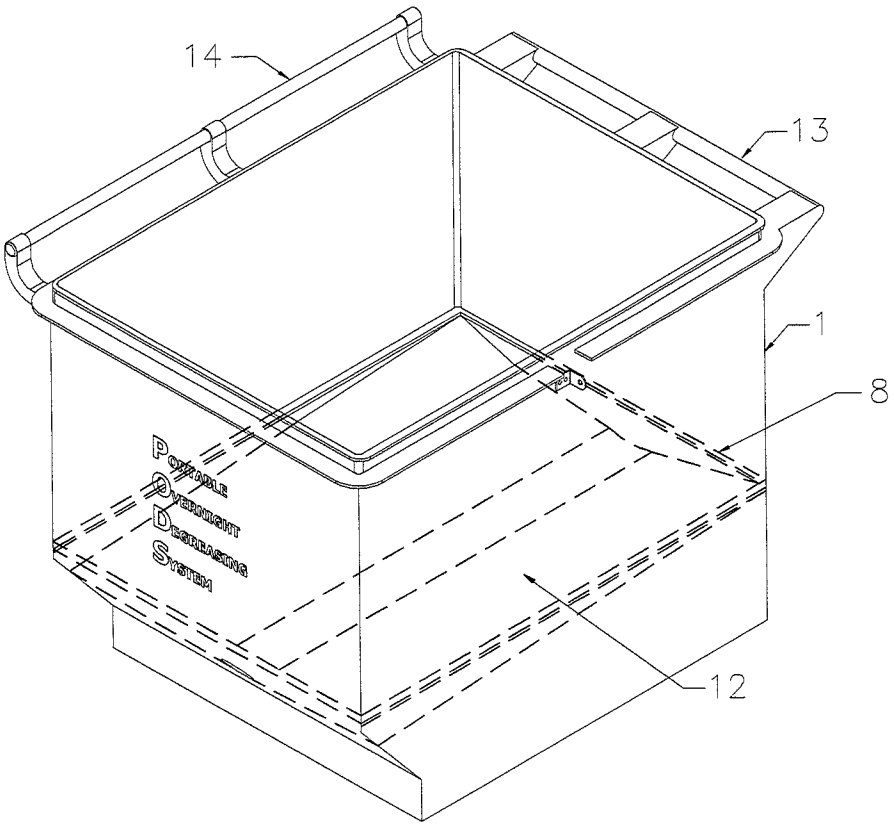
Figure 3:
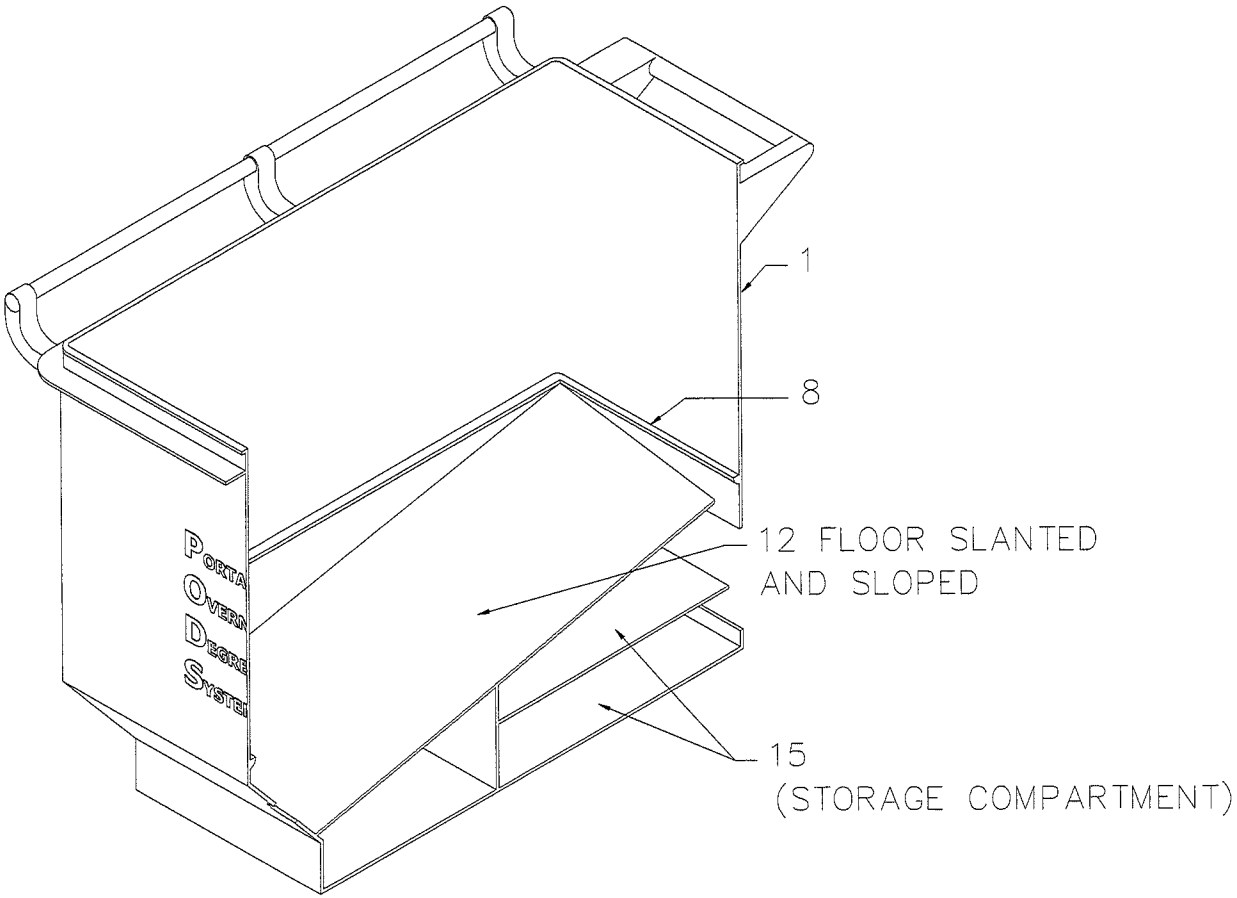
FIG. 3 is a cross-sectional view of the system in FIG. 1.

FIG. 2 shows the hinge 14 where the lid 11 is rotatably connected. A handle 13 is positioned on a wall perpendicular to the wall where the hinge 14 is positioned. The handle 13 is positioned on one or both of the longitudinal ends of the soak tank 1, depending on the preference of the user. Opposite of the open upper end 2 is a slanted floor 12. The slanted floor 12 is bilaterally slanted towards the front wall at an angle of up to 33 degrees, and the slanted floor 12 is slanted towards the drain at an angle of up to 45 degrees. The slant increases the rate of flow into the drain.

Figure 4:
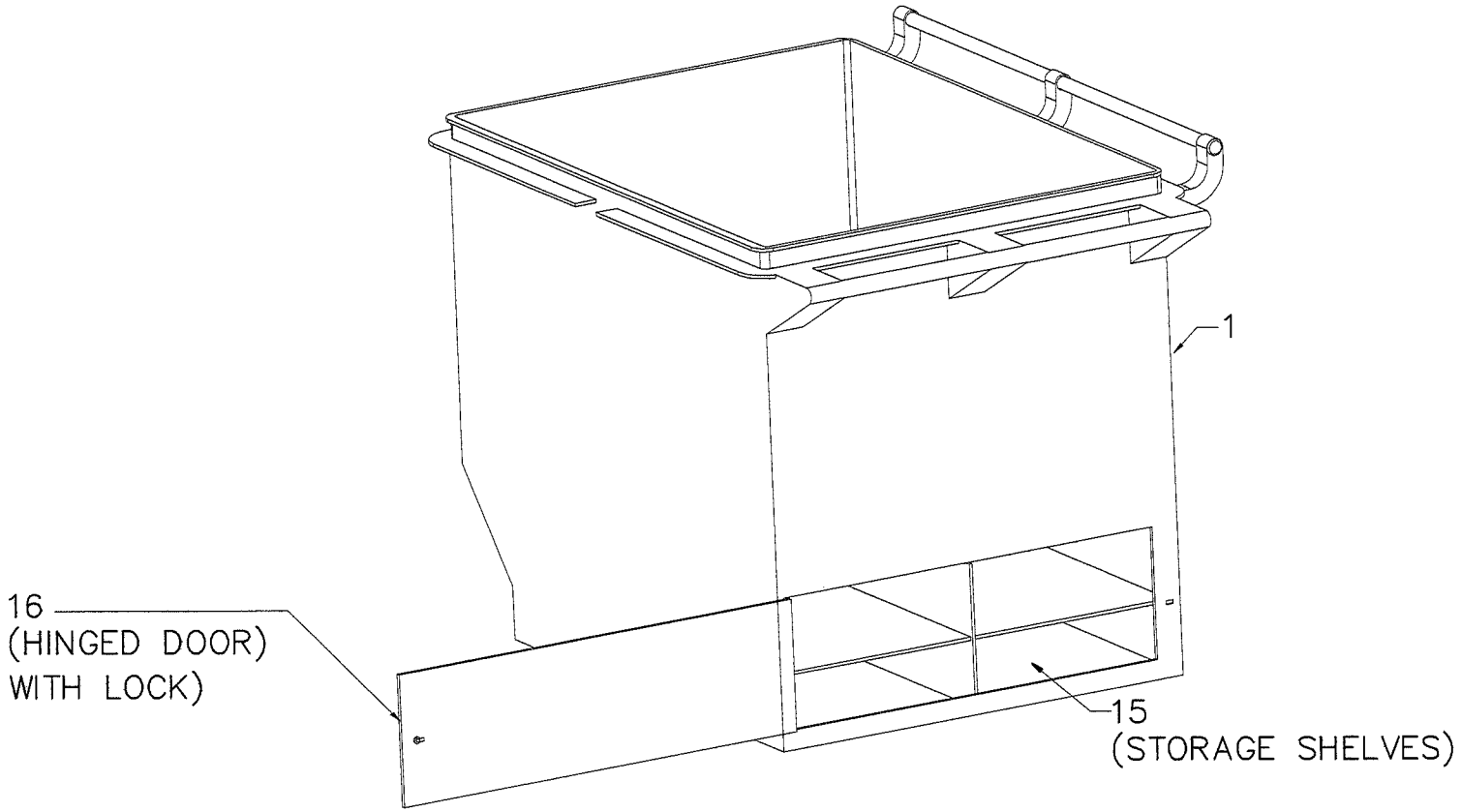
FIG. 4 is a rear sectional view of the system in FIG. 1.

The slanted floor 12 results in an empty space between the floor 12 and the closed lower end 3. The area is filled with storage compartments 15. The storage compartments 15 hold objects, such as extra bag liners 4, gloves, aprons, etc. The storage compartments 15 are shielded from the outside via a hinge, lockable door 16, as shown in FIG. 4. The storage compartments 15 may be divided into four areas, as shown in FIG. 4, or divided into more or less compartments depending on the intended usage.

The closed lower end 3 of the soak tank 1 comprises four to six caster wheels 10 attached to the lower surface of the closed lower end 3. The wheels 10 include: two 10 to 12 inch swivel caster wheels 10 positioned on the front of the lower surface; two 10 to 12 inch swivel caster wheels 10 positioned on the back of the lower surface; and two 10 to 12 inch stationary caster wheels 10 positioned in the center of the bottom surface on lateral sides. The swivel wheels 10 on the front and back allow the system to rotate 360 degrees about an axis of rotation that is drawn vertically through the center of the system, which is advantageous for maneuvering into small spaces because the system does not have to make wide turns. The two stationary wheels help steady the device and prevent incidental lateral movement while moving the system. All the wheels 10 are 10 to 12 inch in size to allow the system to roll over bumps and cracks without becoming stuck due to the wheels being small enough to fit into the cracks or not tall enough to roll over a bump.

Figure 6:
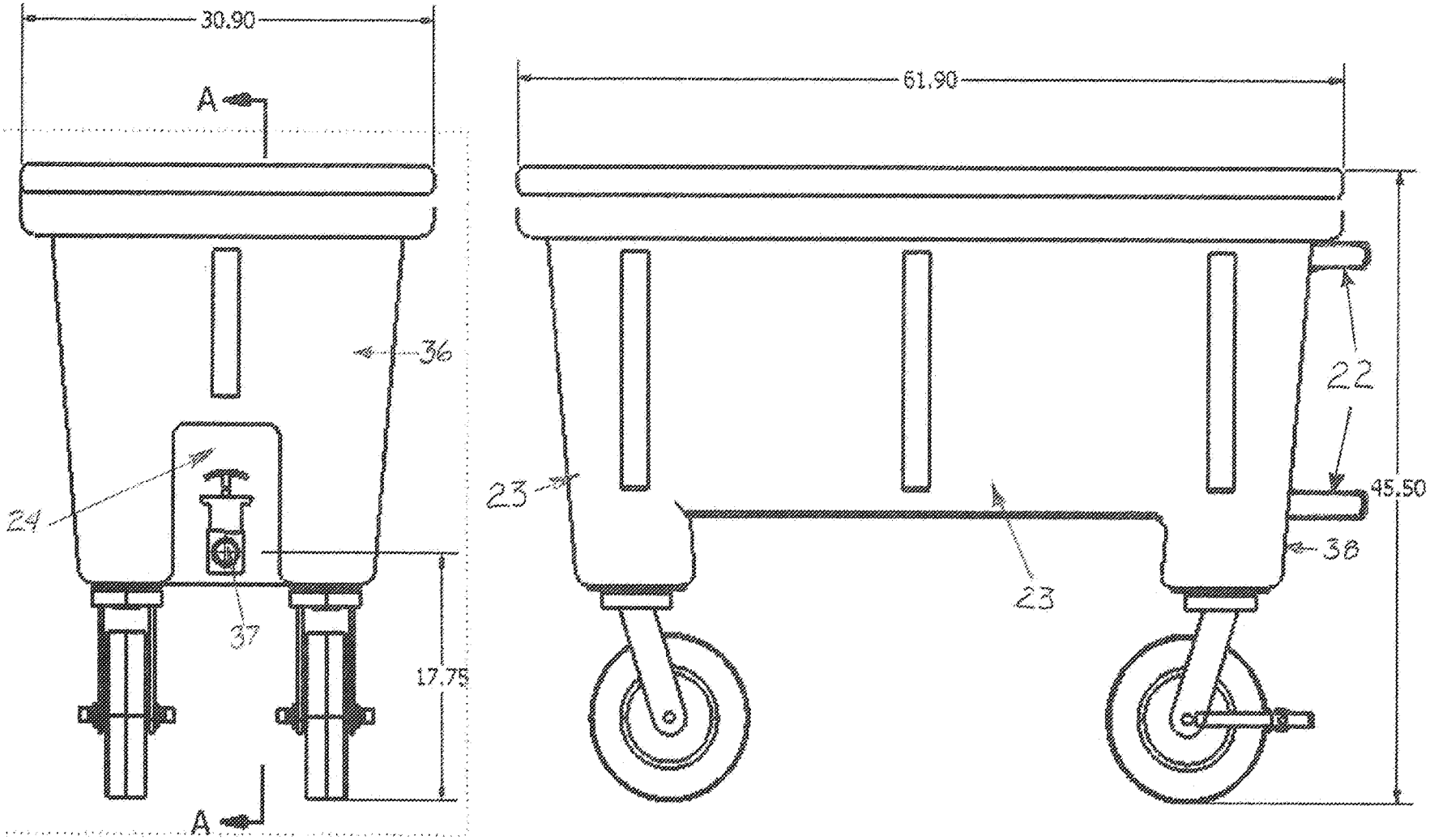
FIG. 6 is a front sectional view and a side sectional view of the third embodiment.

FIG. 5 shows a second embodiment where an optional electric heater 20 may be included in the soak tank 1 to reduce the time necessary for cleaning the kitchen appliances FIG. 6 shows a third embodiment of the soak tank 23. The soak tank includes a front wall 36, where the front wall is slanted at 30-60 degrees relative to the horizontal, to allow a complete drainage of the drain, piping and interior of the soak tank 23. The soak tank 23 utilizes the same interior surface and pipping as the first embodiment of the soak tank 1. The front wall 36 includes a concave portion 24 in the exterior surface of the front wall, where the drain 37 is positioned. The drain 37 does not extend beyond the most forward portions of the front wall to prevent damaging the drain 37 while maneuvering the soak tank 23. As shown in FIG. 6, when the soak tank 23 is viewed laterally the drain 37 cannot be viewed because it is positioned in the concave portion 24 of the front wall. The rear wall 38, opposite the front wall, includes supports 22 that extend horizontally from the rear wall. The supports 22 are rigid and made of material with sufficient strength to not buckle or bend under the weight of the soak tank 23. This allows the soak tank 23 to be rested upon the supports 22, thereby minimizing the amount of floor space occupied by the soak tank 23 during storage or transportation. The supports 22 may be made of stainless steel, rubber, plastic or any other rigid material that can support the weight of the soak tank 23 without deformation.

Figure 7:
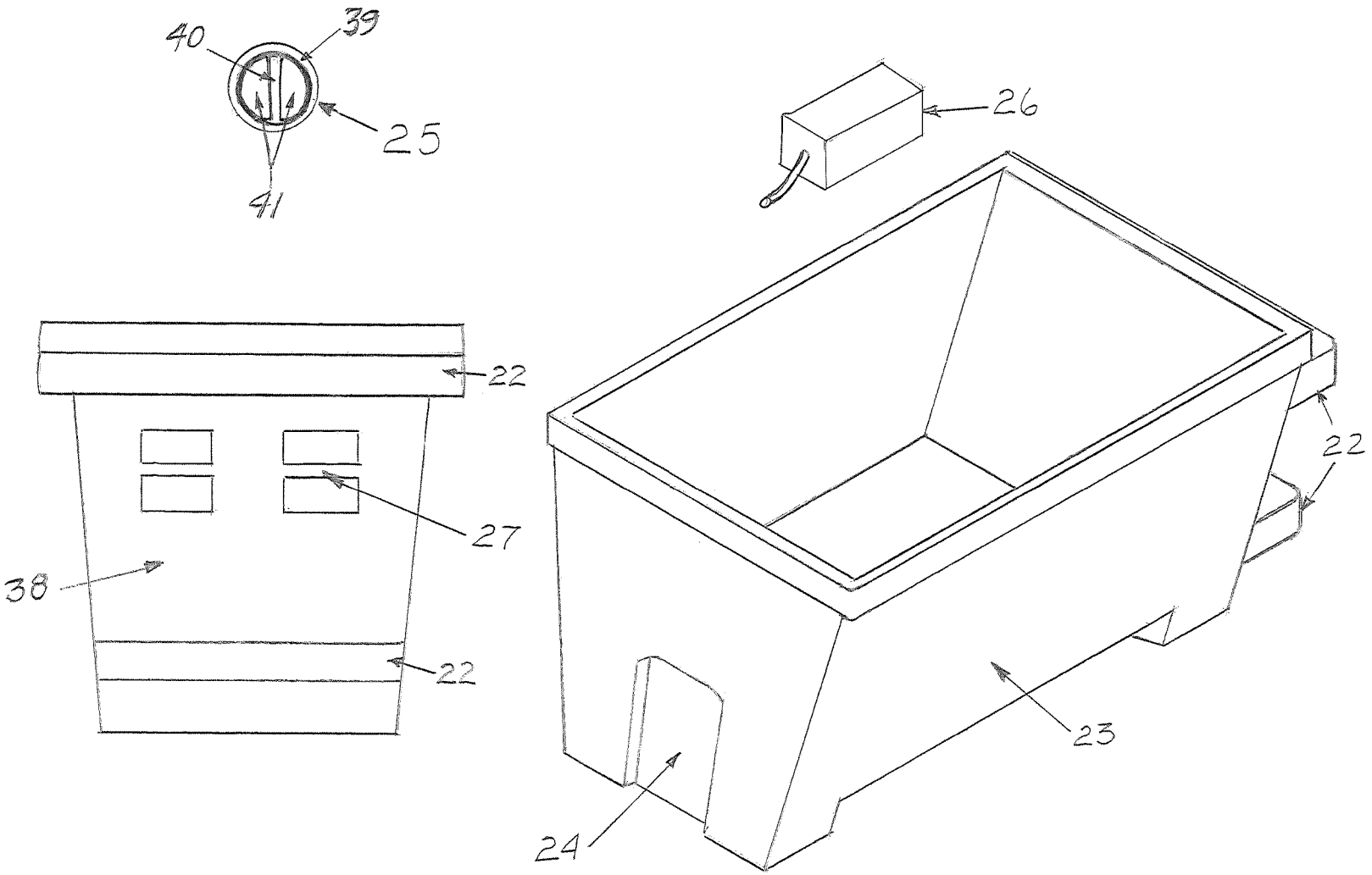
FIG. 7 is a rear sectional view and a perspective view of the system of FIG. 6.

FIG. 7 shows the rear wall 38 where handles 27 are positioned to steer the soak tank 23 during movement. An agitator 26 is also shown in an exploded view, wherein the agitator would be secured to the rim of the soak tank 23 on the interior surface during use. The agitator 26 would rest far enough into the soak tank to contact the cleaning fluid during use. The agitator 26 also creates turbulence within the cleaning fluid, during use, which accelerates the cleaning process. FIG. 7 also depicts the donut plug 25. The donut plug 25 includes a rubber gasket 39 that circumscribes the perimeter of the donut plug 25 and a rod 40 that bisects the donut plug 25. The rod 40 divides the donut plug 25 into two semi-circular passages 41 that allow the passage of fluid there through. The rod 40 also functions as a handle for positioning or removing the donut plug 25 from the aperture in the disposable liner bag 4 and the soak tank 23; thereby providing or removing a fluid impermeable seal between the donut plug 25, disposable bag liner 4 and the opening in the floor of the soak tank 23.

Figure 8:
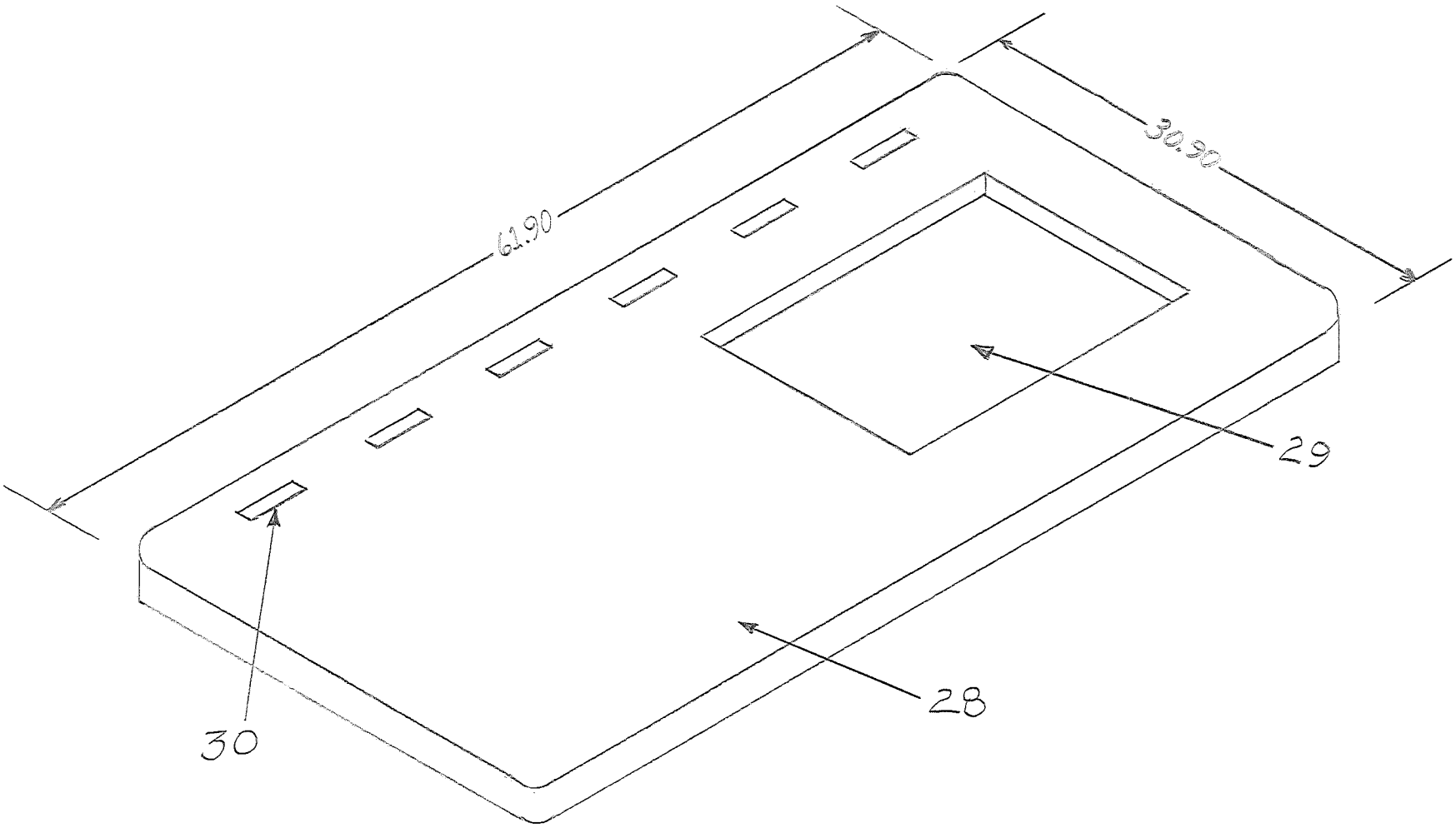
FIG. 8 is a perspective view of the lid.

FIG. 8 shows the lid 28 of the third embodiment 23. The lid 28 includes vents 30 that are utilized during the degreasing process to exhaust the chemicals, but are not used when the soak tank 23 is used as a clean workstation. The lid 28 also includes a recessed pocket 29 sized and configured to allow the placement of a cutting board 34 within the pocket 29, even while a protective cover 33 is disposed over the pocket 29 and below the cutting board 34. The lid 28 is secured to the soak tank 23 by hinges and is lockable to the soak tank 23, in the same manner as the lid and soak tank are secured in the first embodiment.

Figure 9:
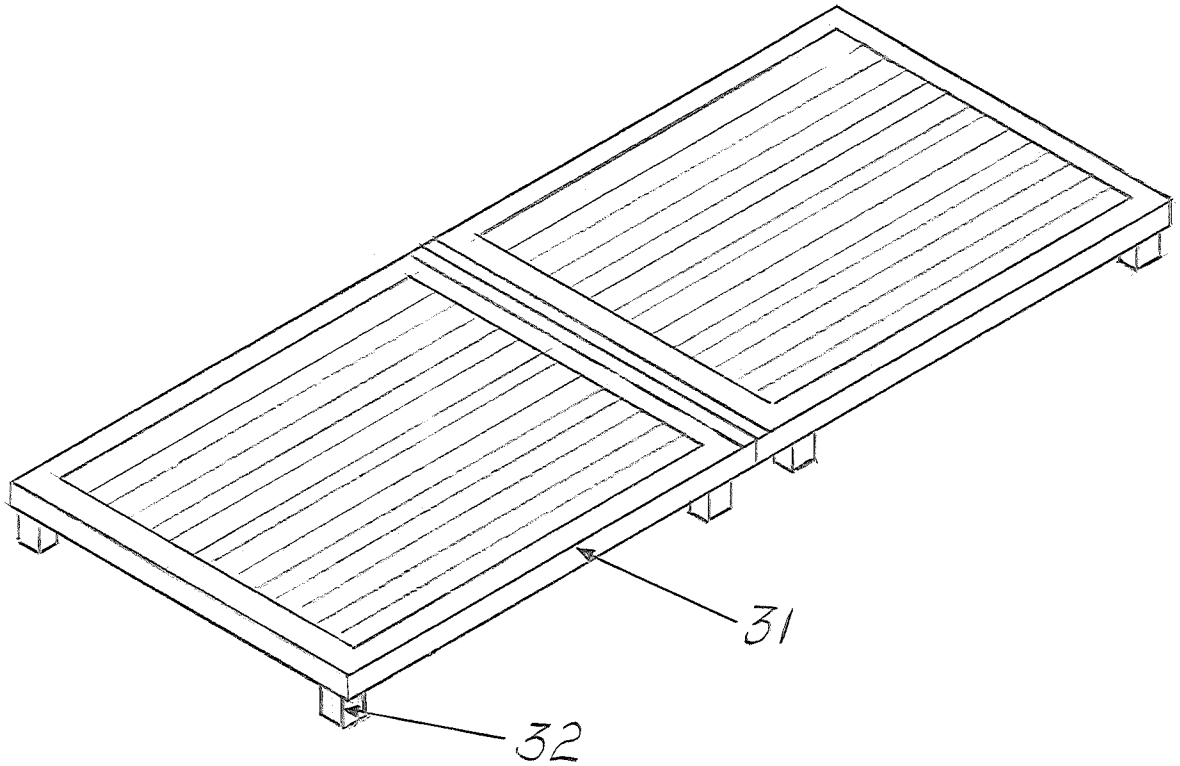
FIG. 9 is a perspective view of the grates.

FIG. 9 shows the grate 31. The grate 31 may be used in any embodiment. The grate 31 includes two separable halves, wherein each half includes four legs 32 that are positioned on the lower surface of the grate 31. When positioned within the tank the legs 31 rest upon the interior floor of the soak tank with the liner bag disposed there between. The legs 32 keep the bag liner 4 flat on the interior floor of the soak tank.

Figure 10:
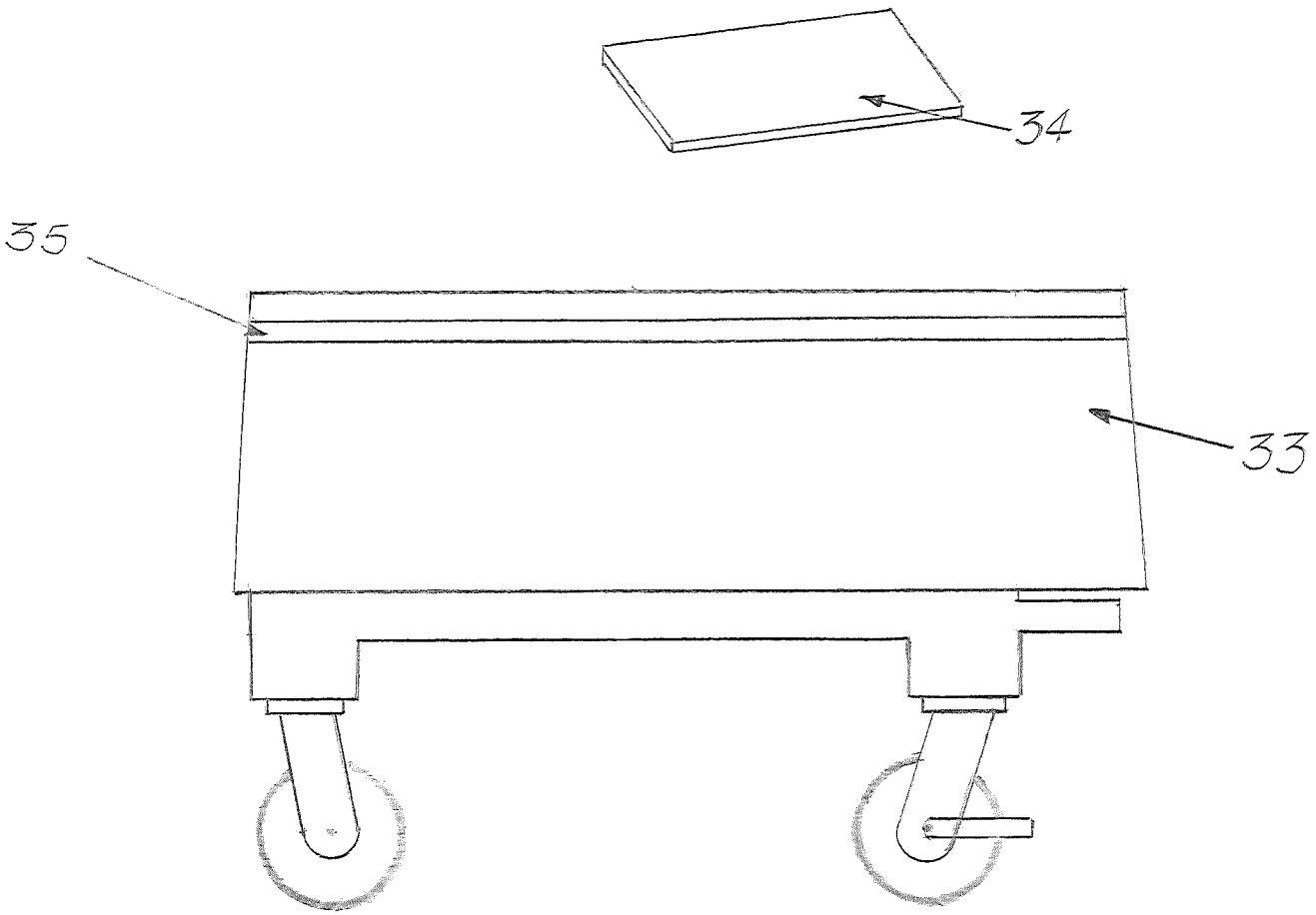
FIG. 10 is a side view of the system of FIG. 6.

FIG. 10 shows the system of the third embodiment in its workstation mode. The soak tank 23 is in its upright position upon the caster wheels, the lid 28 is closed and locked and the protective cover 33 is secured over the lid 28 and at least half of the soak tank 23. The protective cover 33 thereby covers the vents 30 and the recessed pocket 29. The cutting board 34 is then placed upon the protective cover 33 within the recessed pocket 29. The protective cover 33 is an impermeable layer that creates a clean workstation upon the lid 28 of the soak tank 23 and is secured by a band or ties 35.

The above-mentioned features of the portable overnight degreasing system are illustrative, but not limited to the exact design, shape, size, form, materials, parts, function and usage. The illustrative features that form the basis of the portable soak tank 1, 23 can be changed or modified by those skilled in the art to accommodate the needs of the business, organizations or individuals who can benefit from the invention. This system can be utilized in a variety of cleaning methods, from sustained emersion in chemical solutions, to the use of heating elements 20 and pumps to expedite the cleaning process. Those skilled in the art can take advantage of the latest green technology to provide additional cleaning methods for this invention.

I claim:

1. A portable degreasing system comprising:

A soak tank comprising four adjacent walls, wherein the adjacent walls are each perpendicular to one another, a slanted floor in an interior of the soak tank for urging solutions towards an opening at a front end of the slanted floor, proximate to a front wall of the soak tank a removable, disposable bag liner disposed within the interior of the soak tank during use, wherein the bag liner extends from an open end of the soak tank to the floor of the soak tank, a removable grate disposed within the soak tank, wherein the grate is held steady by a catch and/or legs during use, a valve mechanism for starting and stopping the flow of fluid from the interior of the soak tank to the exterior, wherein the valve mechanism is disposed in an outer face of the front wall of the soak tank, wherein the valve mechanism further comprises a drain opening disposed on the front wall of the soak tank, and wherein the valve mechanism comprises at least one of a knife gate, a ball valve, a butterfly valve, or a disk valve, the front wall is slanted at 30-60 degrees with respect to the horizontal, so that that an outer surface of the front wall is adapted to be slanted substantially downward towards the ground beneath the tank when the tank is positioned on the ground, thereby assisting in complete drainage from the interior of the soak tank, a lockable lid for enclosing the interior of the soak tank during use, wherein the lockable lid comprises a recessed pocket sized and configured to receive a cutting board;

a cutting board removably positioned within the recessed pocket;

a cleaning solution for removing carbon and grease from equipment configured to be placed in the soak tank, during degreasing;

an impermeable protective cover configured to be placed over the lid and at least half of the soak tank during use as a work station, wherein the impermeable protective cover is disposed between the recessed pocket and the cutting board during use as a work station; and a plurality of caster wheels.

2. The system of claim 1, wherein the plurality of caster wheels is attached to a bottom of the soak tank, wherein the caster wheels swivel 360 degrees.

3. The system of claim 2, wherein the plurality of caster wheels includes one of four or six wheels.

4. The system of claim 3, wherein the caster wheels are 10 to 12 inches in diameter to allow the system to roll over bumps and cracks.

5. The system of claim 1, wherein the slanted floor of the interior of the soak tank is slanted towards the front wall of the interior of the soak tank at a 3 percent downgrade from a rear wall of the soak tank, thereby forcing the fluid to flow towards the drain opening.

6. The system of claim 1, wherein the removable, disposable bag liner is 3 mils thick to provide durability and flexibility simultaneously.

7. The system of claim 6, wherein the removable, disposable bag liner is constructed of at least one of a durable plastic, rubber or composite.

8. The system of claim 1, wherein the grate includes handles or indentations graspable by the user.

9. The system of claim 1, wherein the grate comprises two coplanar grates within the soak tank during use.

10. The system of claim 1, wherein the system further comprises rigid supports positioned on a rear wall of the soak tank; wherein the supports can support the weight of the soak tank resting upon them.

11. The system of claim 1, wherein the soak tank further comprises a concave portion on the front wall; wherein the drain opening is disposed on the concave portion of the front wall.

12. The system of claim 1, wherein the system further comprises a donut plug configured to provide an impermeable seal between perimeter of the donut plug, an aperture in the disposable bag liner and the drain opening of the soak tank near the front wall.

13. The system of claim 12, wherein the donut plug further comprises a rubber gasket around the perimeter, a rod that bisects the donut plug into two semi-circular passageways that allow the passage of fluid, and the rod is configured to function as a graspable handle.

14. The system of claim 1, wherein the lid comprises vents in the lid for exhausting fumes and pressure from the interior of the soak tank.

15. The system of claim 14, wherein the lid further comprises a gasket around the inner perimeter of the lid for forming a seal with the exterior of the soak tank.

16. The system of claim 1, wherein the system further comprises an agitator that is positioned within the soak tank and configured to agitate the cleaning solution.

17. The system of claim 1, wherein the system further comprises an optional heating element that is positioned within the soak tank and configured to heat the cleaning solution.

18. The system of claim 1, wherein the system further comprising a storage compartment between the slanted floor and a closed end of the soak tank, wherein the storage compartment includes a lockable hinged door.

19. The system of claim 1, wherein the system further comprises a sealed, clean package that holds the protective cover.

* * * * *